United States Patent [19]

Twellmann

[11] Patent Number: 4,832,300

[45] Date of Patent: May 23, 1989

[54] ROTATING BASE WITH PULL-OUT SYSTEM

[75] Inventor: Guenter Twellmann, Spenge-Lenzinghausen, Fed. Rep. of Germany

[73] Assignee: Ninkaplast GmbH, Bad Salzuflen, Fed. Rep. of Germany

[21] Appl. No.: 96,493

[22] Filed: Sep. 15, 1987

[30] Foreign Application Priority Data

Sep. 17, 1986 [DE] Fed. Rep. of Germany ... 8624899[U]

[51] Int. Cl.[4] ..... A47B 88/10

[52] U.S. Cl. ..... 248/240.1; 312/302; 312/322

[58] Field of Search ..... 248/240, 240.1, 240.3, 248/293, 349; 211/162, 144; 312/302, 303, 323, 327, 311, 328, 322

[56] References Cited

U.S. PATENT DOCUMENTS

| | | | |
|---|---|---|---|
| 836,564 | 11/1906 | Cukier | 312/302 X |
| 2,037,919 | 4/1936 | Poe | 312/322 X |
| 2,293,496 | 8/1942 | Egger | 312/322 X |
| 2,647,812 | 8/1953 | Saunders | 312/322 X |
| 2,650,871 | 9/1953 | Holderegger | 312/322 |
| 3,550,982 | 12/1970 | Zaidan | 312/302 |
| 4,582,372 | 4/1986 | Cooper | 312/322 |

FOREIGN PATENT DOCUMENTS

| | | | |
|---|---|---|---|
| 2722629 | 9/1978 | Fed. Rep. of Germany | 312/238 |
| 645371 | 9/1962 | Italy | 312/302 |
| 977734 | 12/1964 | United Kingdom | 312/302 |

*Primary Examiner*—Alvin C. Chin-Shue

*Attorney, Agent, or Firm*—Foley & Lardner, Schwartz, Jeffery, Schwaab, Mack, Blumenthal & Evans

[57] ABSTRACT

A rotating base for furniture which is provided with a pull-out system is fitted with a member which is attached to the body of the furniture so that it rotates about a vertical axis, whereby runway rails to support the rotating base are fitted to the member. The rotational movement of the member in relation to the body of the furniture is coupled by a coupling mechanism in such a way to the linear pulling out movement of the rotating base in relation to the member, that the rotating base cannot strike against the body of the funiture in the pulled-out position.

6 Claims, 2 Drawing Sheets

ROTATING BASE WITH PULL-OUT SYSTEM

BACKGROUND OF THE INVENTION

The invention relates to a rotating base with pull-out system for furniture according to the characterising portion of the main claim.

Rotating bases of normally semi-circular or circular-sector shape in plan view are frequently built into corner cupboards as special bases so that it is easier to reach items which are kept in the rear corner of the cupboard. A rotating base which can be rotated exclusively about a vertical axis can only partially be turned outwards from the door opening of the corner cupboard. However, fittings for rotating bases of this type are known with which the rotating base can be pulled out of the door opening after it has been rotated like a drawer so that the stored items can be reached more easily.

Conventional systems for the attachment of the rotating base so that it can be pulled out are provided with a fork fitting which is bolted on to a side wall of the body of the furniture at the edge of the door opening at the height of the rotating base and to which a rotatable member for the rotating base is attached. The semi-circular rotating base is attached to the member with the aid of a runway rail running along the straight edge of the rotating base. The member can also be rotated when the rotating base is pulled out. There is a danger therefore that the pulled out rotating base will be rotated inadvertently and strike the edge of the door opening. Moreover it is difficult to control the linear movement and the rotational movement of the rotating base when pulling out or pushing in such a way that the rotating base does not strike or rub against the walls of the body of the furniture.

As the bolts for securing the fork fitting have to absorb very large forces because of the relatively short lever arm, problems arise in connection with the stable and permanent attachment of the fork fitting to the body of the furniture. As a door hinge is normally provided at the side edge of the door opening in the area of the lower end, the fork fitting for the lower rotating base must be attached above the hinge so that the lowest rotating base is located relatively far above the base of the body of the furniture. Consequently it is not possible to make optimum use of the storage space.

A further disadvantage of the conventional system consists of the fact that the means of attachment for the rotating base, in particular the runway rail are not covered and consequently are visible and easily soiled at least when the rotating base has been pulled out.

SUMMARY OF THE INVENTION

The object of the invention is to provide a rotating base with a pull-out system, whereby it is ensured that the rotating base in the pulled-out position or during the pulling out or pushing in operation does not strike the body of the furniture.

According to the invention the linear pulling-out movement of the rotating base in relation to the member is coupled to the rotating movement of the member in relation to the body of the furniture by means of a coupling mechanism, so that the rotating base only retains a degree of freedom of movement. The rotating base is thus run necessarily during the rotating, pulling out and pushing in operations in such a way that each point on it is moved on an accurately pre-determined track and by means of this constrained arrangement the rotating base cannot be rotated together with the member in the pulled-out position. A linear movement of the rotating base in relation to the member is also prevented in the pushed-in position. Consequently to fix the end position of the rotating base when it has been pushed in, only a single stop is required which for example limits the swivelling range of the member.

Advantageous developments of the invention are given by the subordinate claims and a stable securing of the rotating base, an easy and flowing movement of it and an aesthetically satisfying covered arrangement of the means of attachment and guiding are provided by these developments.

The attachment of the member to a tube running vertically through the inside of the body and fixed in the area of its upper and lower ends can be supported in a stable manner by the pitching moments and the vertical load forces acting on the tube. Several rotating bases can be attached to the same tube at any height, in particular also close above the furniture base.

The rotating base is for preference made of plastic and provided with an injected control groove for guiding the rotating base during the pulling-out movement. When the control groove has a symmetrical shape, the rotating base can be used both for corner cupboards on which the door is located on the right hand side and on those on which the door is located on the left hand side.

BRIEF DESCRIPTION OF THE DRAWINGS

A preferred example of an embodiment of the invention will be explained below in greater detail on the basis of the drawings.

DETAILED DESCRIPTION OF THE PREFERRED EMBODIMENT

Figure 1:
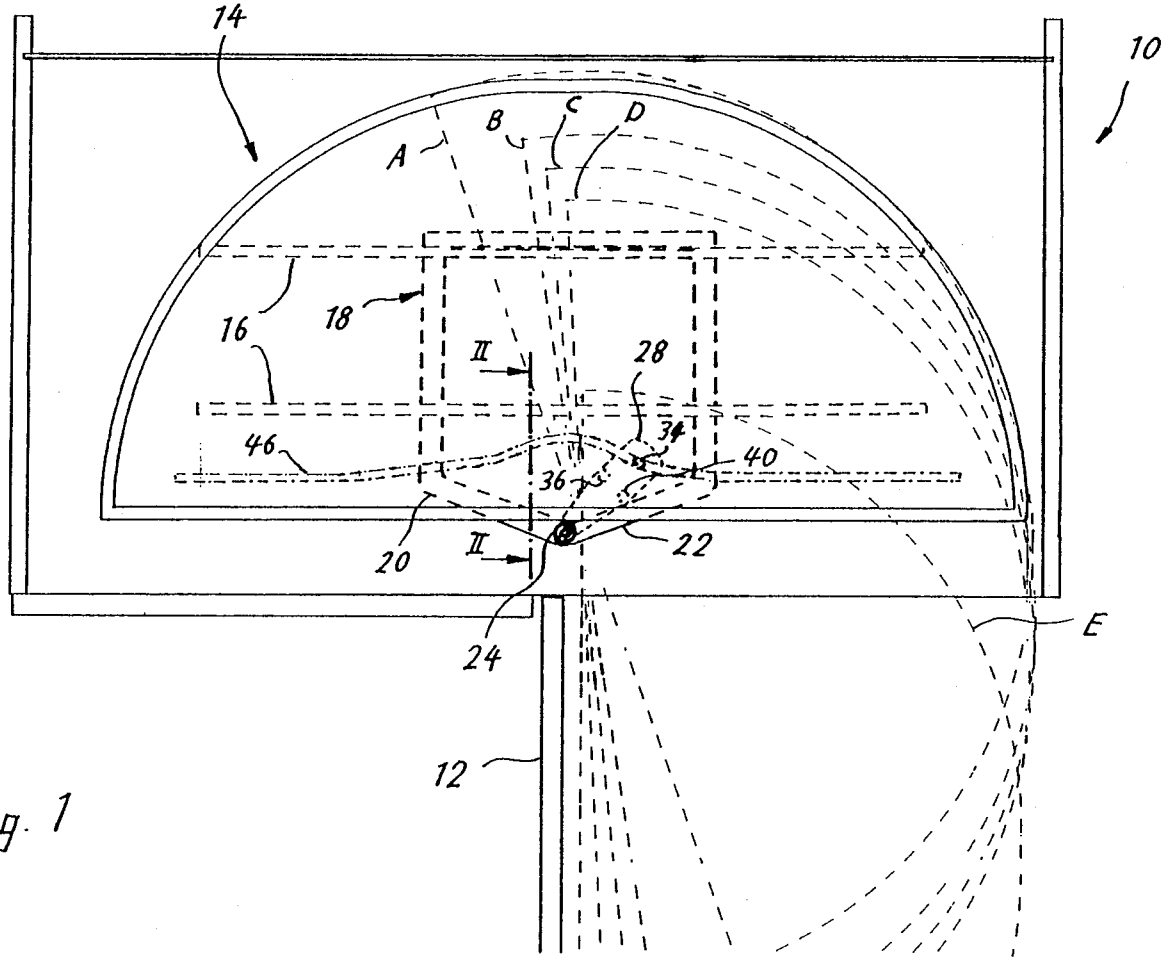
FIG. 1 shows a plan view in diagrammatic form of a corner cupboard with a rotating base and pull-out system according to the invention and FIG. 2 shows a section along the line II—II of FIG. 1.

FIG. 1 shows a view of the base of a corner cupboard 10 for the left hand corner of a fitted kitchen or similar arrangement. The right hand half of the front of the corner cupboard 10 is formed by a door 12. The corner cupboard 10 is fitted with a semi-circular rotating base 14 which is mounted on a frame-shaped member 18 so that it can be displaced by means of two runway rails 16 which run parallel to each other and to the straight front edge of the rotating base. The member 18 is provided with two side pieces 20 and 22 which form an angle between them of about 140°. The vertex of the angle between the side pieces 20 and 22 is constructed as a bushing which accommodates a tube 24 running vertically through the inside of the corner cupboard 10. The tube 24 is attached to the body of the corner cupboard 10 at its upper and lower ends.

Figure 2:
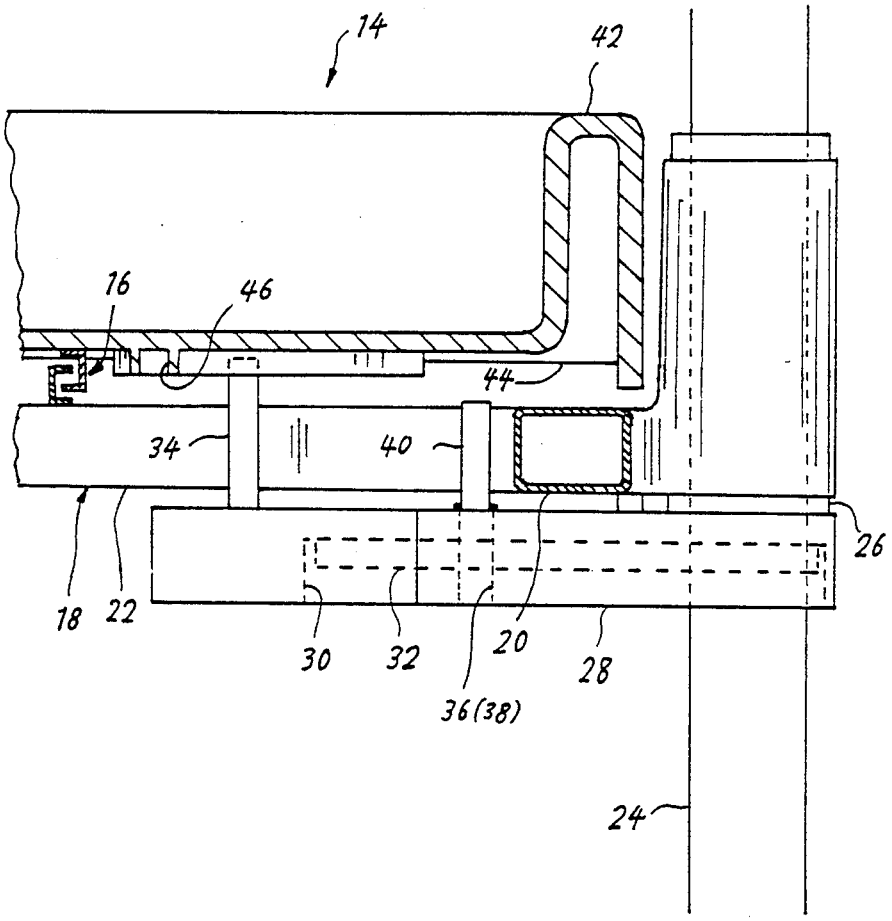

The member 18 can be rotated about the tube 24 and is supported according to FIG. 2 on a support 28 through a slide bushing 26, whereby the tube 24 also passes through the support. The support 28 is provided on its underside with a groove 30, which receives a pin 32 introduced through a transverse hole in the tube 24. The support 28 is supported in the vertical direction and at the same time braced and secured against rotation in relation to the tube 24 by the pin 32. If the rotating base 14 is to be arranged close above the base of the corner cupboard, the support 28 can be bolted directly onto the base of the body of the corner cupboard. In this arrangement the support 28 also forms the lower support for the tube 24.

The support 28 extends like a boom diagonally inside the corner cupboard and is provided at its free end with a rising guide pin 34. The support 28 is also provided with two holes 36 and 38 into which a stop pin 40 can be introduced.

The rotating base 14 is constructed of plastic in one piece and is provided according to FIG. 2 in cross section with an approximately inverted U-shaped edge 42, the external side 44 of which is extended downwards. The runway rails 16, the member 18 and the support 28 are essentially covered by the rotating base 14, whilst a control groove is injected at the lower side of the rotating base 14 into which the guide pin 34 engages.

The control groove 46 is constructed so that it is symmetrical with the axis of symmetry of the rotating base 14 according to FIG. 1 and has in the centre a circular curved section which changes as it moves outwards into two rectilinear sections. The rotating base 14 is run in such a way by the engagement of the guide pin 34 in the control groove 46 that the rotational movement of the rotating base and of the member 18 about the tube 24 is coupled in a predetermined manner with the linear movement of the rotating base 14 along the runway rails 16. In the initial position shown in FIG. 1 the guide pin 34 is located at the beginning of the circular section of the control groove 46. In this position therefore, the rotating base 14 cannot be moved in relation to the member 18 in the direction of the runway rails 16, but can only be rotated together with the member 18 about the tube 24. When the rotating base 14 is rotated clockwise according to FIG. 1, the guide pin 34 first of all passes through the circular section of the control groove 46 and then enters the transitional area between the circular section and the left-hand rectilinear section of the control groove. In this transitional area a linear pulling-out movement in the longitudinal direction of the runway rails 16 is gradually superimposed on the rotational movement of the rotating base. At the same time the rotating base 14 passes through in succession positions A, B, C and D indicated by dashed lines in FIG. 1. When the rotating base 14 is rotated with the member 18 through 90°, the guide pin 34 reaches the rectilinear section of the control groove 46 and from then on the rotating base can only be pulled out in the longitudinal direction of the runway rails 16 until it finally reaches the end position E in which the guide pin 34 touches the closed end of the control groove 46. The final position of the member 18 after the completion of the rotational movement through 90° is also limited in that the internal surface of the side 20 of the member touches the guide pin 34. If the rotating base 14 is pushed in from the end position E a rotational movement is automatically initiated again, when the guide pin 34 reaches the curved section of the control groove 46. In this way the rotating base is returned securely to the initial position. When the initial position is reached, the side 22 of the member 18 touches the stop pin 40.

On a corner cupboard, on which the door is on the left hand side of the front of the cupboard instead of on the right hand side, the support 28 is fitted in a mirror-image position and the stop pin 40 is introduced into the hole 36 of the support. The rotating base 14 can then be rotated in the manner of a mirror-image to the movement shown in FIG. 1, i.e. in the anti-clockwise direction, whereby the guide pin 34 passes through the right hand section of the control groove 46 as shown in FIG. 1.

The control groove 46 may also be arranged if required asymmetrically in relation to the rotating base 14. If this arrangement is adopted for preference at least the curved section of the control groove 46 should be constructed as a component which is attached below the rotating base 14 so that it can be detached and so that it is exchangeable or interchangeable.

I claim:

1. A rotating base with a pull-out system for furniture comprising:

a member secured to the furniture so that said member can be rotated about a vertical axis;

said base being rotatable with said member and linearly slidable relative to said member via runway rails mounted therebetween, and having coupling means for predetermining a sliding position of said base relative to a rotating position of said member and for predetermining a rotating position of said member relative to a sliding position of said base;

wherein said coupling means includes a guide pin attached to a stationary support fixed to the furniture, said guide pin in engagement with a control groove formed on the underside of the rotating base;

wherein said control groove has a circular arc-shaped section having one end progressively extending into a rectilinear section running parallel to said runway rails; and wherein the center of curvature of the circular arc-shaped section coincides with the axis of rotation of the member when the rotating base is located in an initial position inside the furniture.

2. The rotating base according to claim 1, wherein the rotating base comprises a plastic part in one piece, in which the control groove has been injected and which has an edge extending downwards for screening the runway rails, the member and the coupling means.

3. A rotating base with a pull-out system for furniture comprising:

a tube attached at its upper and lower ends thereof to the furniture, said tube thereby extending vertically inside the body of the furniture and being fixed against rotation in relation to the furniture;

a support attached rigidly at one end to the tube whereby said support projects into the inside of the furniture, the other end of said support being unattached to said tube and bearing a guide pin;

a member supported by said support and secured to the furniture so that said member can be rotated about said tube; and said base being rotatable with said member and linearly slidable relative to said member via runway rails mounted therebetween, and having said guide pin attached to said support for predetermining a sliding position of said base relative to a rotating position of said member and for predetermining a rotating position of said member relative to a sliding position of said base.

4. The rotating base according to claim 3, wherein the support comprises a plastic part slid onto the tube said support being provided with a groove on an underside thereof, said groove receiving a pin introduced through a transverse hole in the tube.

5. A rotating base with a pull-out system for furniture comprising:

a member secured to the furniture so that said member can be rotated about a vertical axis, said member being constructed in the form of a frame;

said base being rotatable with said member and linearly slidable relative to said member via runway rails mounted therebetween, and having coupling means for predetermining a sliding position of said base relative to a rotating position of said member and for predetermining a rotating position of said member relative to a sliding position of said base;

a stationary support attached to the furniture and supporting said member;

a control groove formed on the underside of the rotating base and arranged symmetrically with the axis of symmetry of the rotating base;

said coupling means including a guide pin and an interchangeable stop pin;

said guide pin attached to the support and which engages said contral groove, said guide pin defining a terminal position of the member when a side of the member contacts said guide pin; and said interchangeable stop pin attached to the support, said stop pin defining another terminal position of the member when another side of the member contacts said stop pin.

6. The rotating base according to claim 5, wherein the rotating base comprises a plastic part in one piece, in which the control groove has been injected and which has an edge extending downwards for screening the runway rails, the member and the coupling means.

* * * * *